US006016972A

United States Patent [19]

Kantor et al.

[11] Patent Number: 6,016,972

[45] Date of Patent: Jan. 25, 2000

[54] BRIDGELESS ROTARY SPRINKLER

[75] Inventors: Issak Kantor, Rosh Pina; Yoel Zur, Korazim, both of Israel

[73] Assignee: Dan Mamtirim, Hagalil Haelion, Israel

[21] Appl. No.: 09/081,254

[22] Filed: May 19, 1998

[30] Foreign Application Priority Data

May 30, 1997 [IL] Israel ..... 120953

[51] Int. Cl.[7] ..... B05B 3/08

[52] U.S. Cl. ..... 239/222.11; 239/222.13; 239/222.15; 239/222.17; 239/233

[58] Field of Search ..... 239/203, 204, 239/210, 214, 222.11, 222.13, 222.15, 222.17, 225.1, 231, 233, 246, 251, 252, 263

[56] References Cited

U.S. PATENT DOCUMENTS

| | | | |
|---|---|---|---|
| 2,557,206 | 6/1951 | Spender | 239/222.17 |
| 3,006,558 | 10/1961 | Jacobs | 239/222.17 X |
| 3,312,400 | 4/1967 | Clearman . | |
| 3,958,760 | 5/1976 | Rosenberg | 239/453 |
| 4,261,515 | 4/1981 | Rosenberg | 239/222.17 |
| 4,407,455 | 10/1983 | Sargent | 239/222.17 |
| 4,487,368 | 12/1984 | Clearman . | |
| 4,560,108 | 12/1985 | Rubinstein | 239/222.17 |
| 4,583,689 | 4/1986 | Rosenberg | 239/381 |
| 4,754,925 | 7/1988 | Rubinstein . | |
| 4,783,005 | 11/1988 | Rosenberg | 239/222.17 |
| 4,817,869 | 4/1989 | Rubinstein | 239/222.17 |
| 5,765,945 | 6/1998 | Palmer . | |

FOREIGN PATENT DOCUMENTS

| | | |
|---|---|---|
| 2772 | 9/1944 | Israel . |
| 3346 | 2/1946 | Israel . |
| 7148 | 1/1953 | Israel . |
| 20118 | 10/1993 | Israel . |
| 260244 | 7/1949 | Switzerland . |
| 642632 | 7/1948 | United Kingdom . |

*Primary Examiner*—Andres Kashnikow
*Assistant Examiner*—Robin O. Evans
*Attorney, Agent, or Firm*—Greer, Burns & Crain Ltd.

[57] ABSTRACT

A rotary sprinkler comprising a body member fitted with a water inlet for coupling to a water irrigation supply and an outlet nozzle at an end of a stem member vertically projecting from the body, a swivel distribution member rotatably articulated to the stem member and formed with at least one deflection surface being in stream communication with the outlet nozzle. The deflection surface is adapted for generating a tangent reaction force imparting rotary motion to the distribution member.

16 Claims, 7 Drawing Sheets

BRIDGELESS ROTARY SPRINKLER

FIELD OF THE INVENTION

The present invention is in the field of rotary sprinklers and more specifically it is concerned with the kind having a rotary distributing member for irrigating a circular pattern.

BACKGROUND OF THE INVENTION

In the following description and claims the term "distribution member" refers to a rotatable outlet deflector nozzle adapted for emitting the irrigation water, while establishing reactionary force components for rotating thereof. Such distribution members are at times referred to also as "rotatable or rotary distributors", "swivels", "reaction swivels", etc.

Typically, rotary sprinklers are divided into two categories, namely sprayers and sprinklers. Sprayers, typically have essentially low flow rate and short irrigation range. The high speed of revolution of the distribution member causes atomization of the water jet into fine spray, which lacks the energy to reach longer distances. The second category, referring to sprinklers, is suitable for use with essentially high-flow rates and provides higher irrigation range than sprayers.

It is well known that excessive irrigation of plants and in particular of plantlets, is harmful and even fatal for plants. In particular, the problem of excessive irrigation occurs in greenhouses, where ventilation and evaporation are relatively low.

Some rotary sprinklers comprise a bridging member for supporting the rotary distribution member at its upper end. However, the bridging member in such sprinklers is an obstacle for the water emitted from the distribution member, whereby a full circular path is not obtained. Even more so, in many designs of sprinklers dripping occurs below the sprinkler which without suitable draining means might be harmful for the plants.

In another type of rotary sprinkler there is no bridging member. However, in such sprinklers the rotary distribution member is mounted over a rotary shaft rotating within the nozzle, the lower end of the shaft being connected to a drive mechanism, typically being a hydraulic turbine or ball driven mechanism.

The drawback of such an arrangement is that it requires the additional drive mechanism, which generates some friction, resulting in some loss of revolution speed of the distribution member. Even more so, such drive mechanisms are vulnerable to mechanical faults caused, in particular, as a result of dirt or insects entering into the drive mechanism.

It is thus an object of the present invention to provide a new and improved rotary sprinkler, being a combination of a sprayer and a sprinkler, wherein a relatively fine water spray is emitted to an essentially high range and wherein the above referred to drawbacks are essentially reduced or overcome.

BRIEF SUMMARY OF THE INVENTION

According to the present invention, there is provided a rotary sprinkler comprising:

- a body member fitted with a water inlet for coupling to a water irrigation supply, and an outlet nozzle at an end of a stem member vertically projecting from said body;
- a swivel distribution member rotatably articulated to said stem member and formed with at least one deflection surface being in stream communication with said outlet nozzle; said at least one deflection grove being adapted for generating a tangent reaction force imparting rotary motion to said distribution member.

By a preferred embodiment, said at least one deflection surface is a deflection groove which still preferably is an open duct extending from adjacent said outlet nozzle of said body member.

Typically, the distribution member comprises two or more deflection groove, oriented such that the tangent reaction forces generated by said surfaces are in the same direction. Preferably, said deflection groove are symmetrical, however, according to a specific application, the deflection groove may be asymmetric so as to emit water at different angles thus ensuring improved water precipitation.

By still a preferred embodiment of the invention, the stem member is formed with a radially projecting ring, and said swivel distribution member comprises a downward projecting portion adapted for receiving said stem member with a shoulder adapted for snapping engagement with the radial ring of said stem member. Typically, the downward projecting portion of said swivel distribution member comprises two essentially vertical slits for imparting it some elasticity.

By one application, the downward projecting portions of said swivel distribution member comprises one or more openings for wash-out of dirt and insects.

By another application of the present invention the rotary sprinkler is a pop-up type sprinkler, wherein said swivel distribution member is vertically displaceable over the stem member between a first, retracted position in which it engages an opening of said outlet nozzle, while said distribution member is at rest, and a second, extracted position in which it disengages from said opening to swivel about said stem, said swivel distribution member being vertically displaced by axial components of water flow reaction forces.

Preferably, in accordance with any of the above arrangements, there is provided a friction reducing member intermediate said swivel distribution member and said stem member. By a preferred application, said friction reducing member is a spacer.

BRIEF DESCRIPTION OF THE DRAWINGS

For better understanding, the invention will now be described, by a non-limiting example, with reference to the accompanying drawings, in which.

DETAILED DESCRIPTION OF SPECIFIC EMBODIMENTS

Figure 1A:
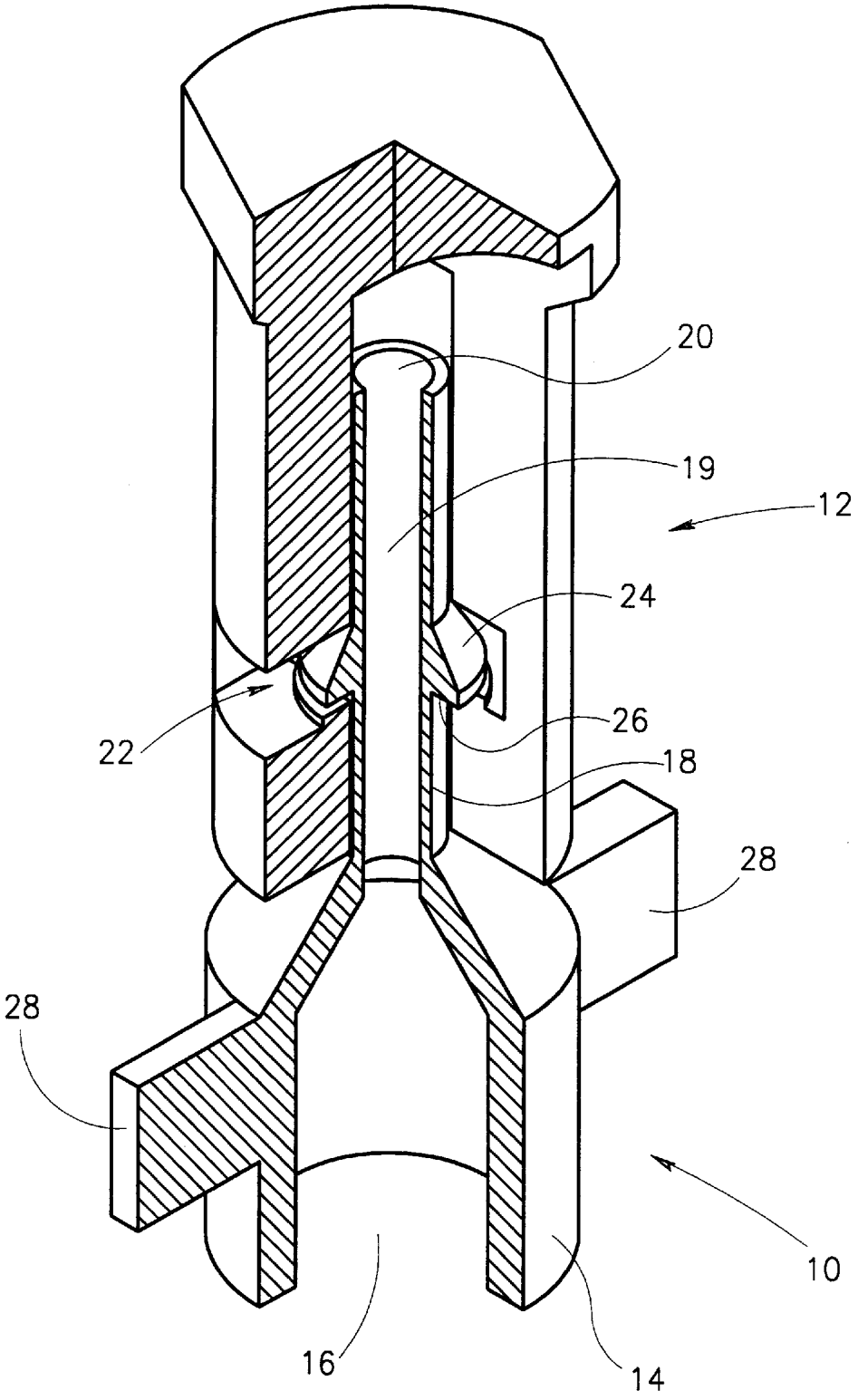
FIG. 1A is partially sectioned isometric view of a first embodiment of a sprinkler in accordance with the present invention.
Figure 1B:
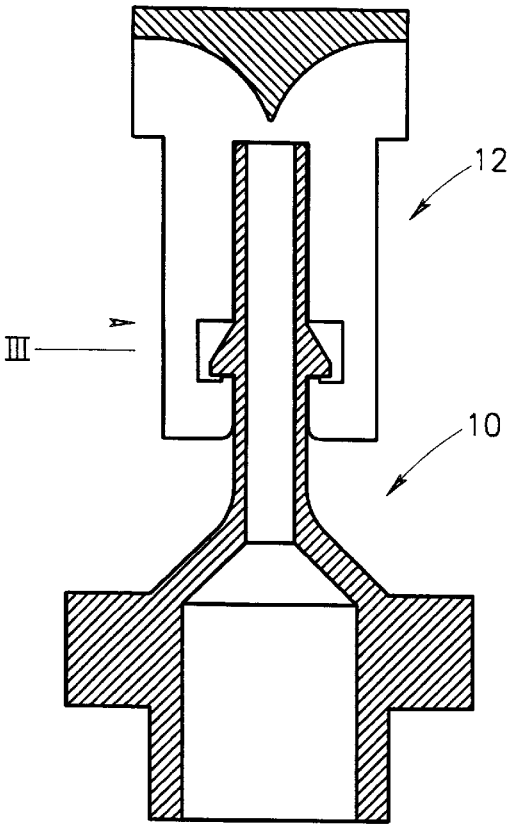
FIG. 1B is a longitudinal cross-section of the sprinkler seen in FIG. 1A.
Figure 2:
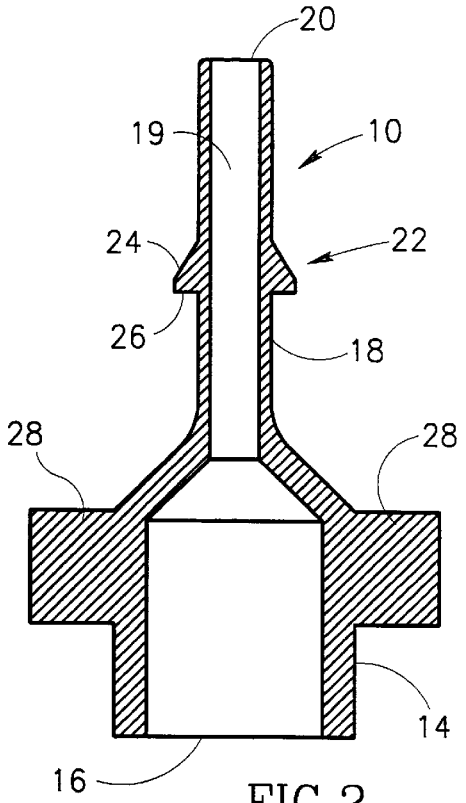
FIG. 2 is a longitudinal cross-section of the body member seen in FIGS. 1A and 1B.

Attention is first directed to FIGS. 1A and 1B of the drawings illustrating a first embodiment of a rotary sprinkler in accordance with the present invention. The sprinkler comprises a body member generally designated 10 and a distribution member generally designated 12 rotatably articulated to the body member 10 as will hereinafter be explained in detail. As can further be seen in FIG. 2, the body member 10 consists of a lower portion 14 for connecting to a water supply line (not shown) by any known manner, and a water inlet 16 for ingress of irrigation water. A stem portion 18 vertically extends from the lower portion 14 with a lumen 19 formed at its upper end with an outlet nozzle 20. The stem portion 18 is formed also with an annular radial projection 22 having a slanting upper surface 24 and an essentially horizontal and flat bottom surface 26.

The lower portion 14 is further formed with two radially projecting shoulders 28 for improving grasping of the sprinkler while connecting to a water supply line (not shown).

Figure 3:
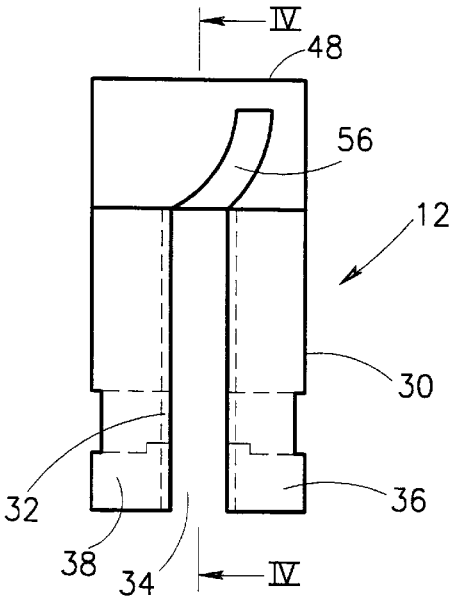
FIG. 3 is a side view along arrow III in FIG. 1B, of the distribution member only.
Figure 4:
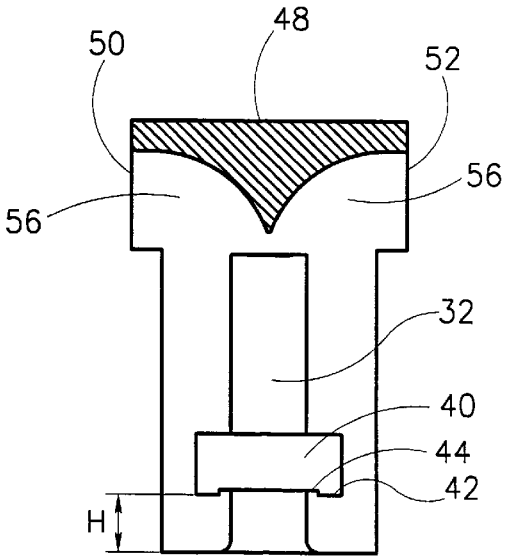
FIG. 4 is a longitudinal cross-section of the distribution member along line IV—IV seen in FIG. 3.
Figure 5:
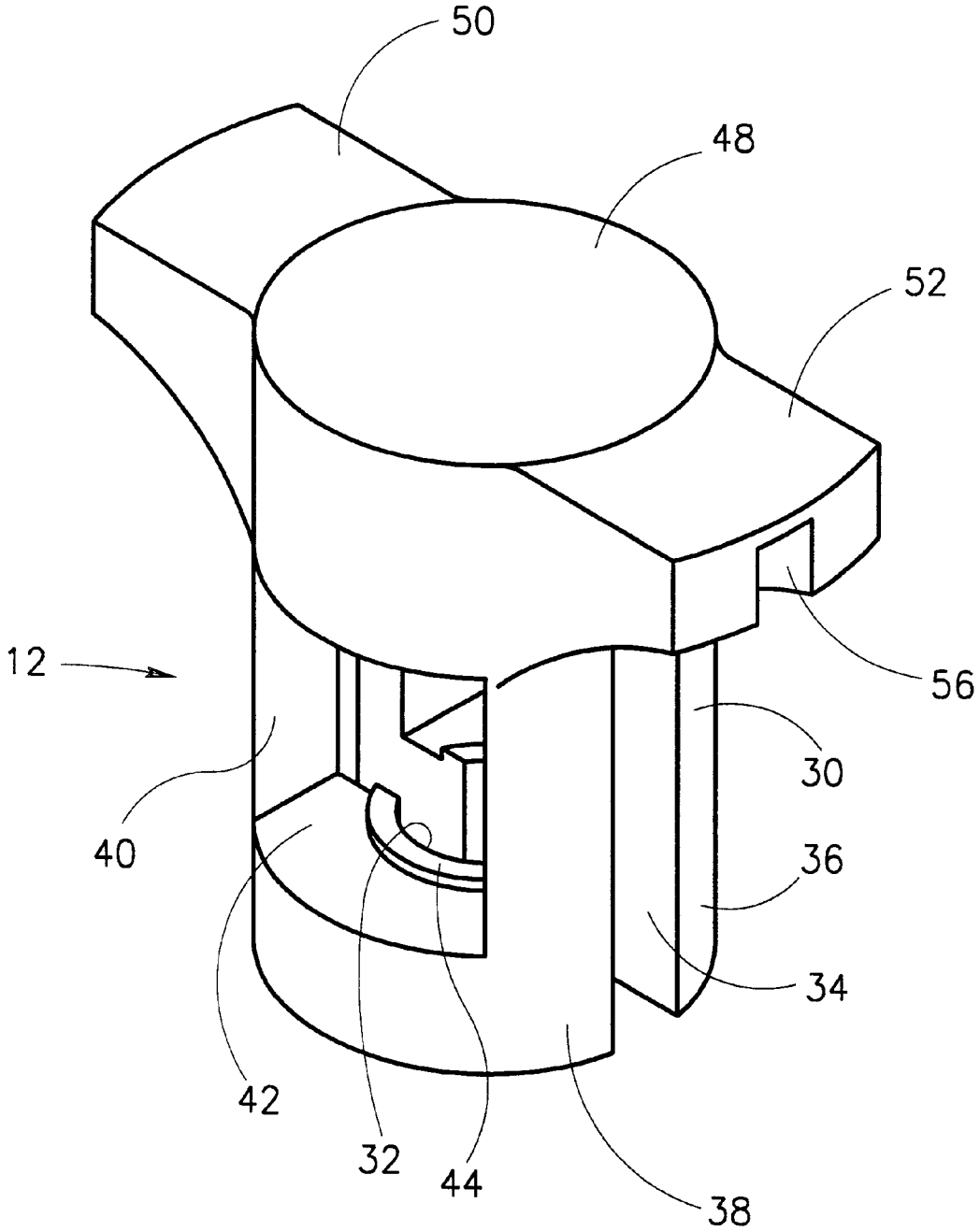
FIG. 5 is an isometric view of the distribution member seen in FIGS. 3 and 4.

FIGS. 3–5 of the drawings are directed to the swivel distribution member 12 generally having T-like shape. The distribution member is formed with a central cylindric cavity 32 and a vertical through-cut 34 which divides leg portion 30 into segments 36 and 38. Each of the leg segments 36 and 38 is formed with an opening 40 having a bottom surface 42 and a circular projection 44 encircling cavity 32.

A head portion 48 of the distribution member 12 consists of two lateral projections 50 and 52 each formed with a deflection grove 56 which in fact is an open duct curved in a manner so as to deflect an axial jet of water into an essentially radial direction generating a tangent reaction force for imparting rotary motion to the distribution member 12.

It should be appreciated that the vertical cuts 34 render the leg segments 36 and 38 some flexibility and that the diameter of the cylindric cavity 32 corresponds with the external diameter of the stem portion 18 of body member 10. Furthermore, it should be noted that the stem portion 18 corresponds in height with the length of cavity 32 as will hereinafter become apparent.

Assembling the rotary sprinkler is merely by mounting the swivel distribution member 12 over the stem portion 18 of body member 14, whereby a snap-type engagement is established therebetween, with the bottom surface 26 of the annular projection 22 bearing against the circular projection 44 of the distribution member 12, as can best be seen in FIGS. 1A and 1B, thus preventing axial displacement of distribution member 12 with respect to body member 10.

The arrangement is such that water ingressing via water inlet 16 flows via the lumen 19 of the stem member 18 and ejects via outlet nozzle 20, where it encounters the symmetric deflection groves 56, whereby it is divided into two streams, each of which emits from the distribution member as a stream of droplets, entailing swiveling of the distribution member 12. The essentially high speed of revolution of the deflection member 12 results in essentially large sized droplets reaching essentially long distances as compared with a static sprayer having a similar flow rate.

The open deflection groves 56 which serve as fluid ducts are easy to manufacture and easy to clean as compared with closed, tubular conduits. Additionally, there is no problem of insects, which may occlude such conduits. Even more so, using an open duct allows improved control of water precipitation.

Figure 6A:
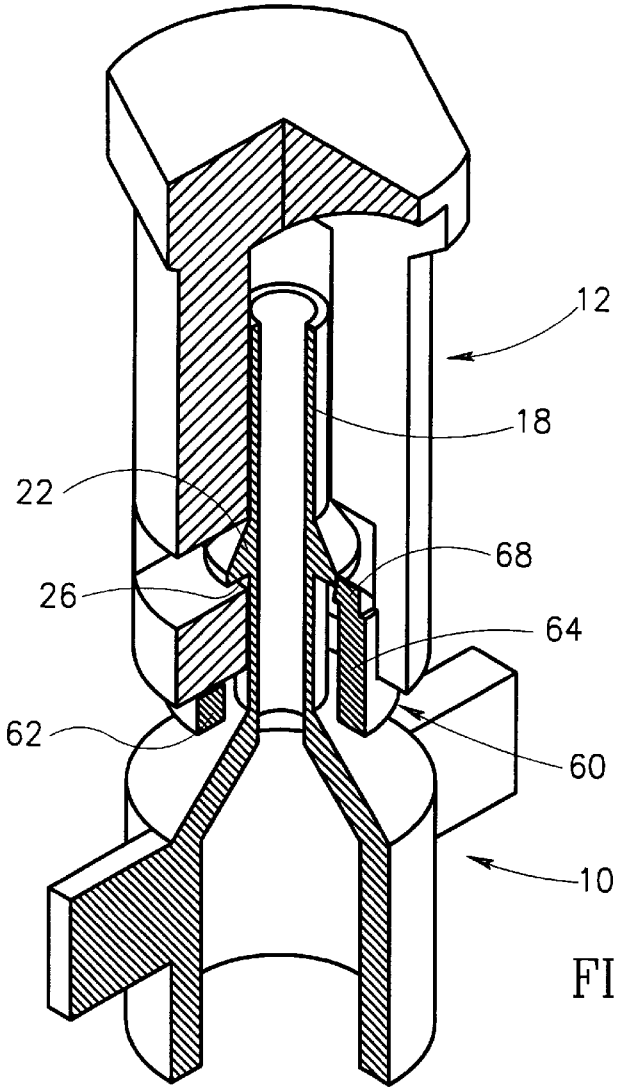
FIG. 6A is a longitudinal cross-section of a second embodiment of a rotary sprinkler according to the present invention fitted with a friction reducing member.
Figure 6B:
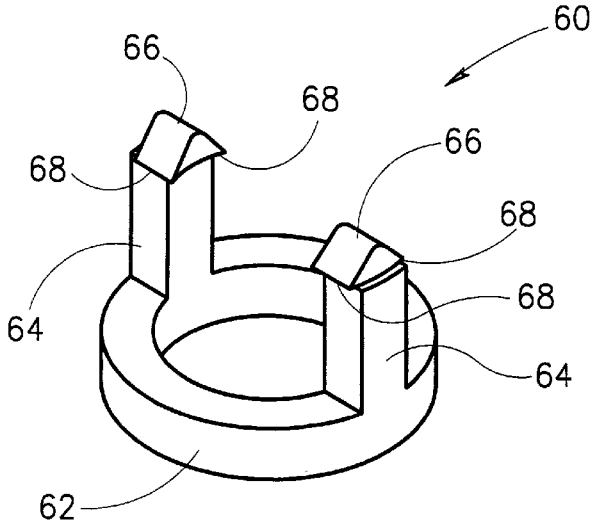
FIG. 6B is an isometric view of the friction reducing member seen in FIG. 6A.

Further attention is now directed to FIGS. 6A and 6B, in which another embodiment of a rotary sprinkler in accordance with the present invention is illustrated, and in which, for the sake of clarity, the same elements as in the previous embodiment are indicated by the same reference numbers.

As seen in FIG. 6A, body member 10 is similar to the body member 10 described with reference to the previous embodiment. However, in order to prevent friction between the rotating member 12 and body member 10, there is provided an intermediate friction reducing member 60, which can be seen in detail in FIG. 6B. The friction reducing member 60 has a ring portion 62 having an internal diameter suitable for mounting over the projection 22 of shank 18 of the body member 10, and for loosely rotating over the lower portion of shank 18. The friction reducing member 60 further comprises two upwardly extending legs 64 each provided with a tapering end 66 having lateral projections 68 with an essentially flat bottom surface. The length of legs 64 corresponds with the distance of surface 42 of distribution member 12 from a lowermost surface thereof (indicted in FIG. 4 as H), whereby upon inserting legs 64 through opening 34 of the distribution member 12, the lateral projections 68 snappingly engage over the surfaces 42 of the distribution member, as seen in FIG. 6A.

The assembled distribution member 12 is then mounted over the shank 18 of body member 10 as explained in connection with the previous embodiment, whereby the lower surface 26 of annular projection 22 of shank 18 bears against the annular projection 44 of the distribution member 12, preventing axial displacement of distribution member 12 with respect to body member 10. The arrangement is such that the friction reducing member actually serves as a spacer for preventing friction of the rotating member 12 over the shank 18 owing to pressure exerted by the rotating member 12 over the shank.

Figure 7A:
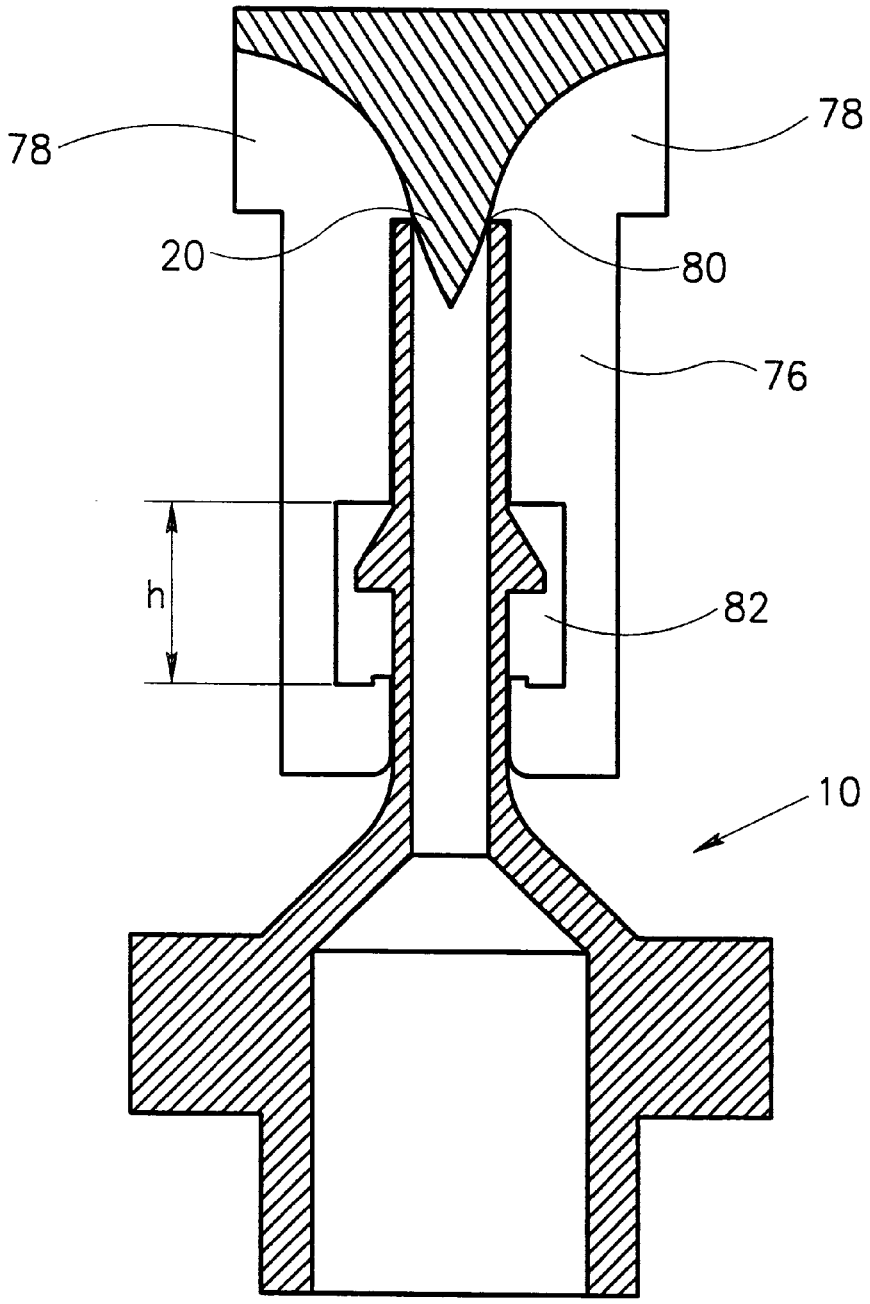
FIG. 7A is a longitudinal cross-section of a pop-up rotary sprinkler, in accordance with the second embodiment of the present invention, the sprinkler in its retracted position.
Figure 7B:
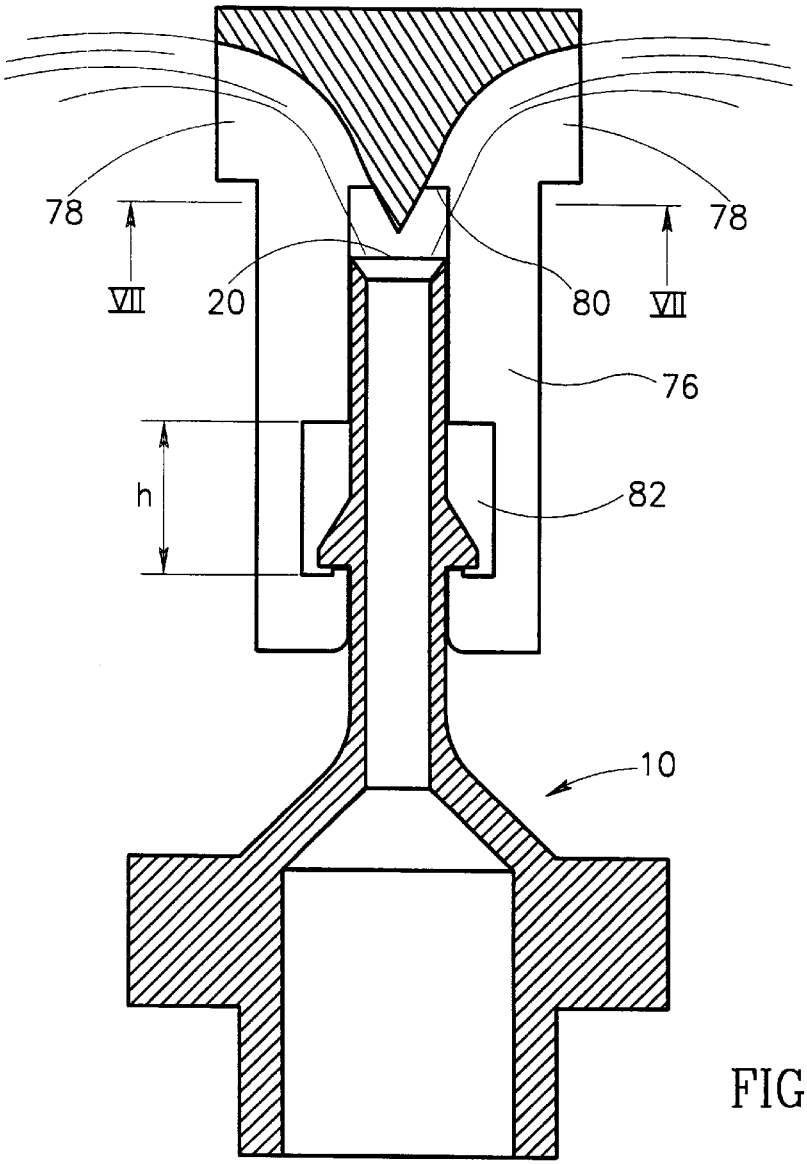
FIG. 7B is a longitudinal cross-section of the sprinkler seen in FIG. 7A in its extracted position.
Figure 7C:
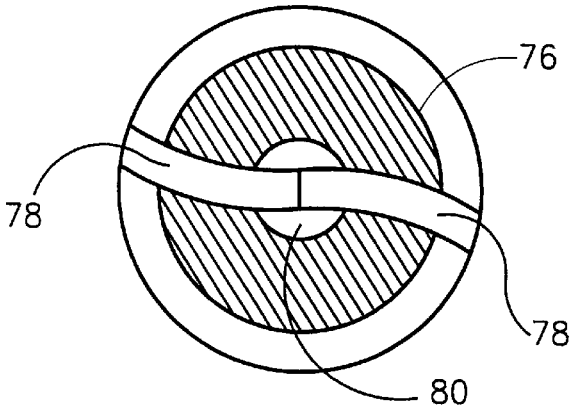
FIG. 7C is a cross-section along line VII—VII in FIG. 7B.

Further reference is now made to FIGS. 7A–7C of the drawings, illustrating a further embodiment of the present invention which is designed as a pop-up sprinkler, differing from the previous embodiments only in the rotary distribution member 76. As seen in these Figs. the distribution member 76 comprises two deflection grooves 78 meeting at an essentially flat surface 80, as can be seen also in FIG. 7B.

Similar to the embodiment described with reference to FIGS. 1–5, the distribution member 76 comprises an opening 82. However, this opening has a height h which is greater than the height of corresponding opening 40 in distribution member 12 of FIGS. 1 to 5, whereby the distribution member 76 is displaceable between a first, retracted position, as seen in FIG. 7A, wherein the surface 80 of rotating member 76 closingly rests over outlet nozzle 20 of the body member 10 and a second, extracted position (seen in FIG. 7B), wherein the surface 80 disengages from the outlet nozzle 20.

It should readily be understood that the axial displacement of the distribution member 76 occurs as a result of a liquid jet immersing from outlet nozzle 20 and encountering surface 80 of the distribution member 76. However, upon closing the liquid supply, the distribution member maintains its retracted position seen in FIG. 7A, whereby outlet nozzle 20 is practically closed, thus preventing dirt and insects from blocking the lumen 19.

Figure 8:
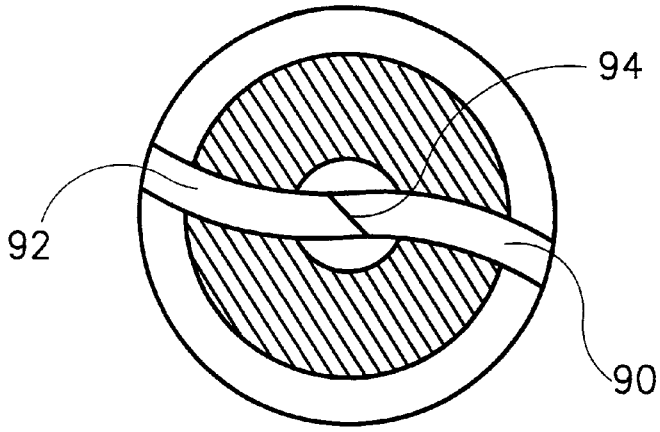
FIG. 8 is a cross-section along line VII—VII in FIG. 7B of a different embodiment wherein the deflection surfaces intersect with one another at an angel.

FIG. 8 of the drawings is a cross-sectional view along line VII—VII in FIG. 7B of a further application wherein the deflection groves 90 and 92 intersect at an angle along line 94, which line is an apex line extending essentially horizontally. This arrangement allows larger manufacturing tolerances, whereby performance of the sprinkler will not be effected even if the intersecting line is not symmetrically disposed with respect to the outlet nozzle (20 in FIG. 7B).

Figure 9:
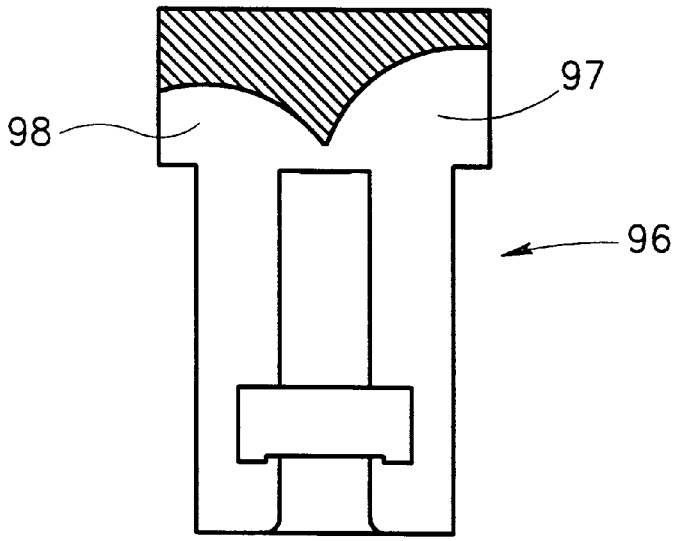
FIG. 9 is a longitudinal cross-section of another application of the distribution member.

In FIG. 9 of the drawings the distribution member 96 is formed with two deflection groves 97 and 98 which groves are asymmetrically disposed within the deflection member, whereby water precipitation is improved.

It is readily understood that the teaching of the present application is applicable, mutatis mutandis, to other arrangements of distribution members, e.g. such having more than two distribution surfaces, and other types of engagement between the distribution member and the body member. It will also be appreciated that the sprinkler according to the present invention may be a pop-up type sprinkler received within a fixed housing as known per-se.

We claim:

1. A bridgeless rotary sprinkler comprising:

a body member fitted with a water inlet for coupling to a water irrigation supply and an outlet nozzle at an end of a stem member vertically projecting from said body, said stem member defining an obstruction-free water passageway;

a swivel distribution member rotatably articulated to said stem member and formed with at least one deflection surface being in stream communication with said outlet nozzle; said deflection surface adapted for generating a tangent reaction force imparting rotary motion to said distribution member; said swivel distribution member being solely supported by said stem member; said swivel distribution member comprises a downward projecting portion having a vertical cut configured for receiving said stem member, said vertical cut configured for snapingly engaging with said stem member.

2. A rotary sprinkler according to claim 1, wherein the deflection surface of said distribution member is an open duct.

3. A rotary sprinkler according to claim 1, wherein said distribution member comprises at least two, symmetrically disposed deflection surfaces, oriented such that the reaction forces generated by said surfaces are in the same direction.

4. A rotary sprinkler according to claim 1, wherein the stem member is formed with a radially projecting ring, and said vertical cut being provided with a shoulder adapted for snapingly engaging with the radial ring of said stem member.

5. A rotary sprinkler according to claim 1, wherein said swivel distribution member is vertically displaceable over the stem member between a first position in which it sealingly engages an opening of said outlet nozzle while in rest, and a second position in which it disengages from said opening to swivel about said stem, said swivel distribution member being vertically displaced by axial components of water flow reaction forces.

6. A rotary sprinkler according to claim 5, wherein the deflection surfaces originate at an essentially flat lowermost end of said distribution member.

7. A rotary shrinker according to claim 4, wherein the downward projecting portion of said swivel distribution member comprises two essentially vertical slits for imparting it some elasticity.

8. A rotary sprinkler according to claim 4, wherein the downward projecting portion of said swivel distribution member comprises at least one opening for dirt wash-out.

9. A rotary sprinkler according to claim 1, further including a friction reducing member disposed between said distribution member and said stem member.

10. A rotary sprinkler according to claim 9, wherein the friction reducing member is a ring made of a material having a low friction coefficient and being attached to said distribution member.

11. A rotary sprinkler according to claim 10, wherein said friction reducing ring is formed with two axial projections adapted for snap-engagement within suitable slits formed in the distribution member.

12. A rotary sprinkler according to claim 1, wherein said deflection surfaces are asymmetrically disposed along a longitudinal axis of the distribution member.

13. A rotary sprinkler according to claim 3, wherein said deflection surfaces intersect at an angel along an essentially horizontal apex.

14. A rotary sprinkler comprising:

a body member fitted with a water inlet for coupling to a water irrigation supply and an outlet nozzle at an end of a stem member vertically projecting from said body;

a swivel distribution member rotatably articulated to said stem member and formed with at least one deflection surface being in stream communication with said outlet nozzle; said deflection surface adapted for generating a tangent reaction force imparting rotary motion to said distribution member;

the stem member is formed with a radially projecting ring, and said swivel distribution member comprises a downward projecting portion receiving said stem member with a shoulder adapted for snapingly engaging with the radial ring of said stem member; and said downwardly projecting portion of said swivel distribution member comprises two essentially vertical slits for providing elasticity.

15. A rotary sprinkler comprising:

a body member fifted with a water inlet for coupling to a water irrigation supply and an outlet nozzle at an end of a stem member vertically projecting from said body;

a swivel distribution member rotatably articulated to said stem member and formed with at least one deflection surface being in stream communication with said outlet nozzle; said deflection surface adapted for generating a tangent reaction force imparting rotary motion to said distribution member;

a friction reducing member is introduced intermediate said swivel distribution member and said stem member, and is configured for loosely rotating about a lower end of said stem member.

16. A rotary sprinkler according to claim 15, wherein said friction reducing member is a ring made of a material having a low friction coefficient and being attached to said distribution member; said friction reducing ring is formed with two axial projections adapted for snap-engagement within suitable slits formed in the distribution member.

* * * * *